United States Patent [19]

Chang

[11] Patent Number: 4,707,032

[45] Date of Patent: Nov. 17, 1987

[54] ARMREST SUPPORT BRACKET FOR A RECLINING SEAT

[76] Inventor: Chung L. Chang, 14335 Rimford Pl., Diamond Bar, Calif. 91765

[21] Appl. No.: 8,387

[22] Filed: Jan. 28, 1987

[51] Int. Cl.[4] ..... A47C 7/54

[52] U.S. Cl. ..... 297/416; 297/417

[58] Field of Search ..... 297/417, 416, 411

[56] References Cited

U.S. PATENT DOCUMENTS

| | | | |
|---|---|---|---|
| 2,661,227 | 12/1953 | Murphy | 297/417 X |
| 3,357,740 | 12/1967 | Vaughn et al. | 297/416 |
| 3,807,799 | 4/1974 | Freedman | 297/417 |
| 3,967,851 | 7/1976 | Stier | 297/416 |
| 4,040,665 | 8/1977 | Wallace et al. | 297/417 |
| 4,067,613 | 1/1978 | Pesiri | 297/417 |
| 4,655,506 | 4/1987 | Wise et al. | 297/488 X |

*Primary Examiner*—Francis K. Zugel

*Attorney, Agent, or Firm*—Knobbe, Martens, Olson and Bear

[57] ABSTRACT

A "U"-shaped bracket having two parallel, flat side plates and a front plate connecting the front ends of the two plates. The rear ends of the parallel plates opposite the front plate are left open. The open end of the U-shaped bracket is sized such that it can be welded onto the cylindrical rod of a seat back frame. Aligned openings are provided in the parallel flat plates of the bracket to accept and rotatably support a cylindrical armrest support rod extending from a pivotable armrest support member. The cylindrical rod includes a laterally extending pin for use in maintaining the armrest support member in a plurality of desired rotational positions with respect to the bracket. The opening in the outside plate of the bracket includes an upwardly and rearwardly extending notch to accept the laterally extending pin of the cylindircal rod. The bracket includes three stops positioned to provide abutments for the laterally extending pin from the cylindrical armrest rod at three usable armrest positions.

19 Claims, 18 Drawing Figures

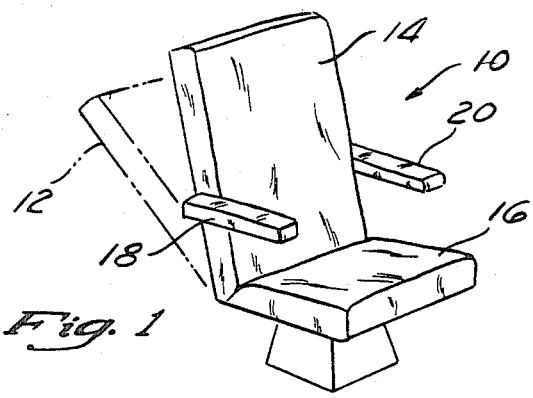
Fig. 1
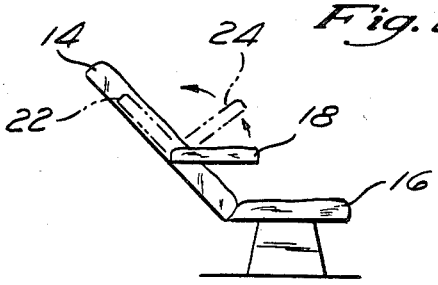
Fig. 2
Fig. 3
(PRIOR ART)
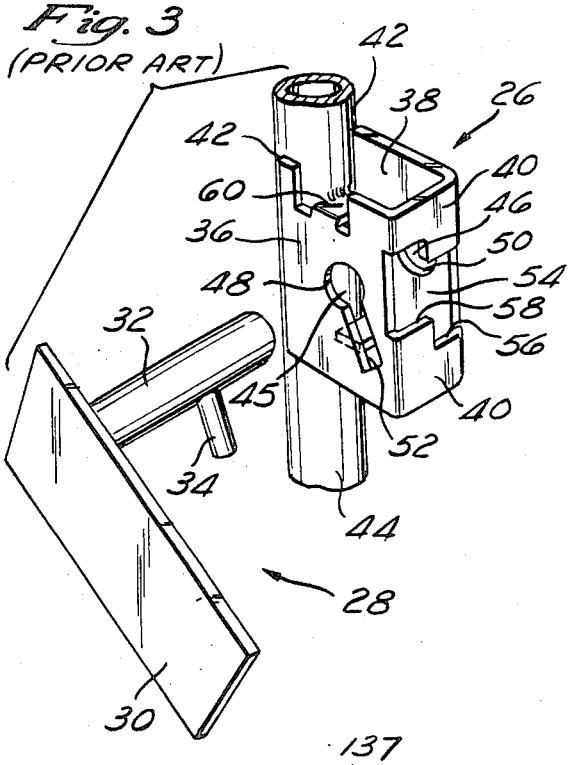
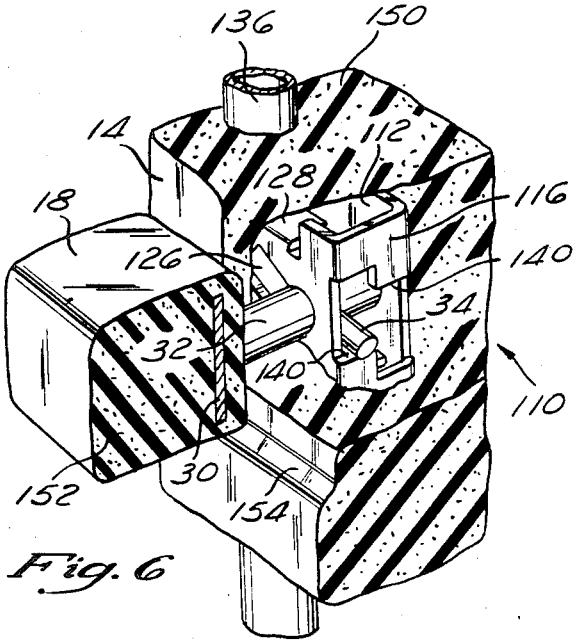
Fig. 6
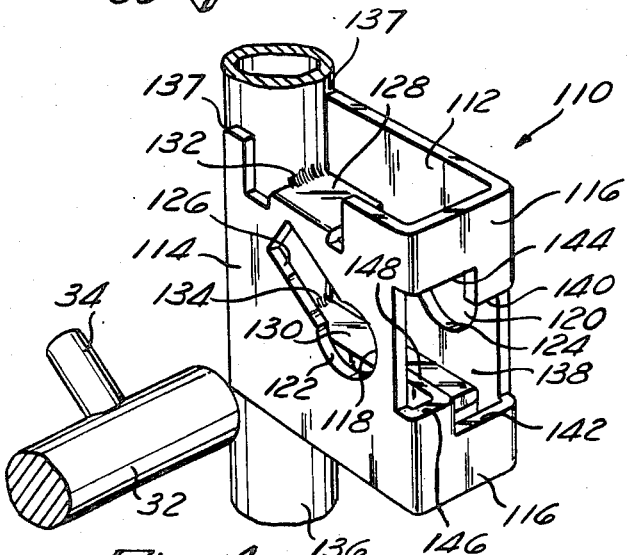
Fig. 4
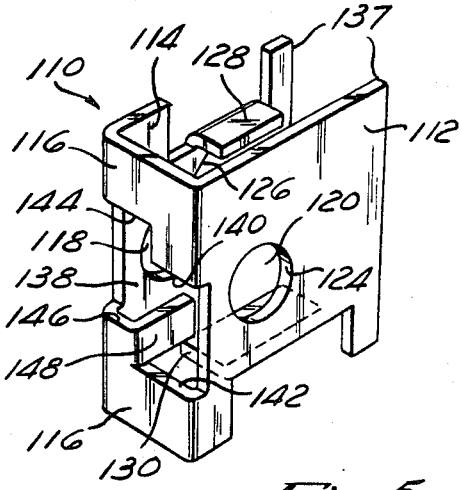
Fig. 5

Fig. 11
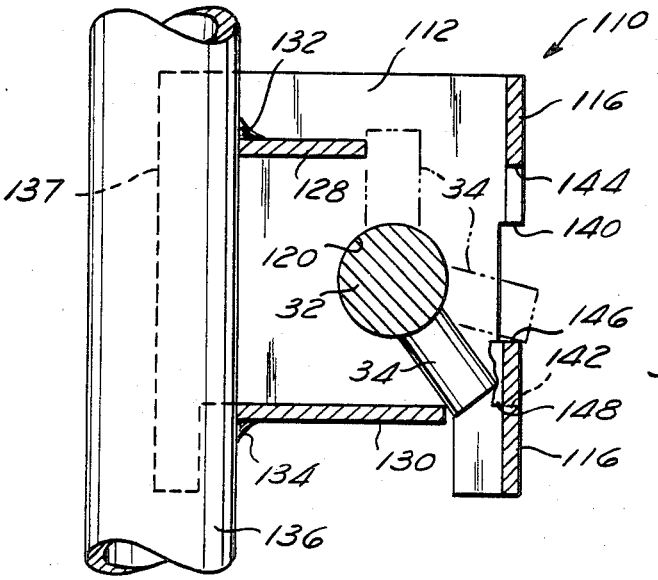
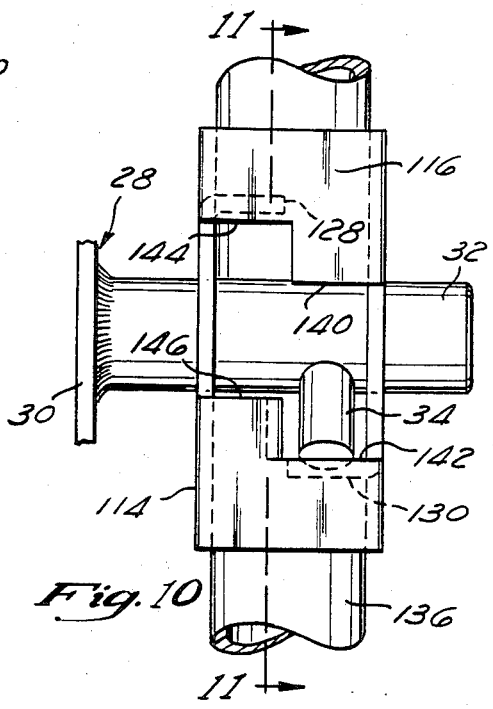
Fig. 10
Fig. 7
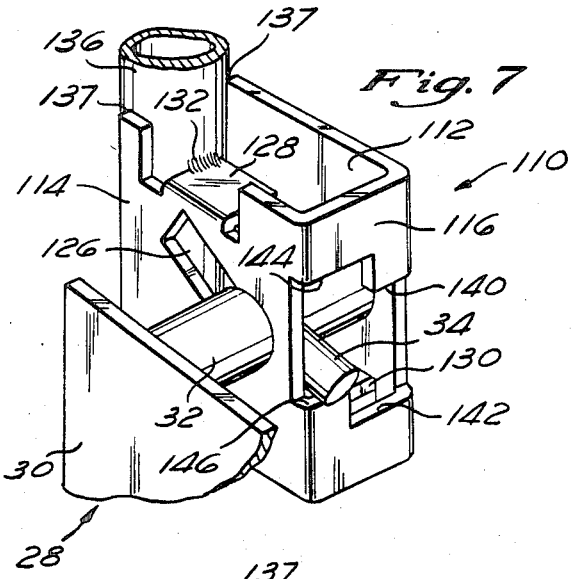
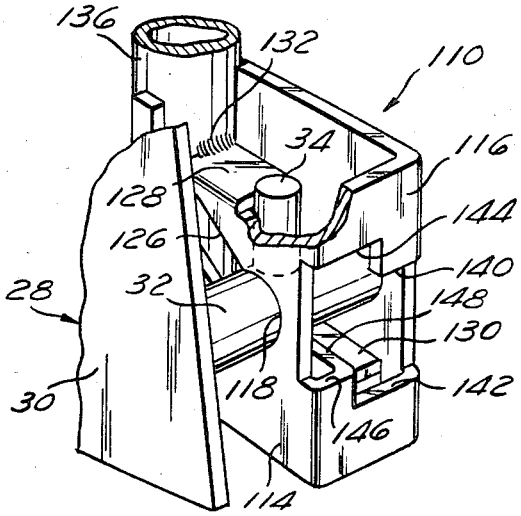
Fig. 8
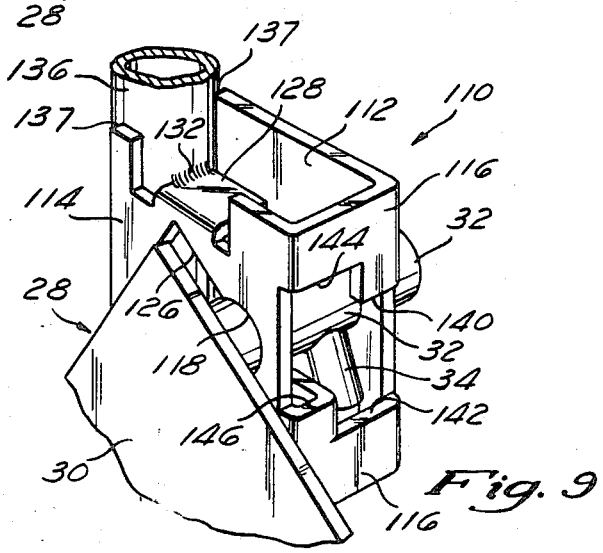
Fig. 9

ARMREST SUPPORT BRACKET FOR A RECLINING SEAT

BACKGROUND OF THE INVENTION

The present invention relates to support brackets, and in particular a support bracket for supporting a multiple position armrest for a reclining seat.

Many chairs and seats are designed to permit some degree of reclining in order to provide additional comfort for the user. The mechanisms which permit reclining in these chairs and seats vary from the extremely complex to the very simple. For example, executive office chairs are often provided with a relatively simple reclining mechanism comprising a spring-loaded hinge located just under the seat bottom so that the seat bottom, armrests and seat back can be tilted back together. An example of a very complex reclining mechanism is that provided for reclining easy chairs. In a reclining easy chair the reclining mechanism usually acts to move the seat back, the seat bottom, the armrests and even a foot rest to various different positions relative to one another in order to provide the most comfortable support for each reclining level.

One of the simplest types of reclining seats is one where the seat back portion is designed so that it may be tilted back while the seat bottom remains stationary. These types of seats are found, for example, in airplanes, buses, automobiles and recreational vehicles. The seat backs of these seats are usually mounted on a hinge located just to the rear of the seat bottom. Further, these seat backs can usually be adjusted and secured in a wide range of angles with respect to the seat bottom. When an armrest is provided for this type of seat, the armrest is often mounted independently of the reclining seat back so that its position is not affected by adjustment of the seat back.

However, under some circumstances, for example in recreational vehicles, it has been found to be desirable to attach the armrests directly to the reclinable seat back frame. Usually, when the seat back is in an upright position, it is desirable to have the armrest extend at slightly less than 90° from the seat back itself, or such that the armrest is approximately parallel to the seat bottom of the seat. When the seat back is reclined, however, the seat back mounted arms will extend upwardly and if the seat back is reclined far enough, the arms will be in an unusable position. For this reason, it is desirable to provide armrests which can be adjusted to different angles with respect to the seat back to accommodate different reclining positions.

FIG. 3 of the drawings of this application shows an example of a prior art armrest bracket and a pivoting armrest support member. The bracket provided for the armrest support element shown in FIG. 3, however, only includes two usable positions for the armrest. The first position is at an angle of slightly less than 90° with the seat back. The second position is a stow-away position where the armrest is aligned approximately parallel to the seat back itself. As indicated previously, it is desirable to provide for at least one additional armrest position so that the armrest can be used comfortably in a reclining position.

SUMMARY OF THE INVENTION

The present invention makes a significant improvement to the prior art armrest support bracket shown in FIG. 3 by providing three usable positions for the armrest using a simple one-piece bracket compatible with the pivoting armrest support member shown in FIG. 3.

In accordance with one embodiment of the invention, a "U"-shaped bracket is provided having an outside flat plate and a parallelly oriented inside flat plate. Aligned circular apertures are provided through the two plates. The aperture in the outside plate has a notch extending upwardly and at an angle to the rear to create a key-like opening suitable for acceptance of a cylindrical rod with a laterally-extending pin. The top of the outside plate has a tab bent in towards the inside plate to provide an abutment for the laterally-extending pin. A front plate connects the two side plates at their front edges. The front plate has an opening with a lower and an upper edge. The lower edge provides a second abutment for the laterally-extending pin. The inside plate has a lower tab bent inwardly towards the outside plate to provide a third abutment for the laterally-extending pin. In this way, three usable positions are provided for the armrest connected to this bracket.

In a further aspect of the invention, the lower bent-in tab extending from the inside plate extends longitudinally from the front plate to a location adjacent the rear of the bracket. The position of the rear of the tab is suitable for use in welding the bracket to a cylindrical rod of a seat back frame.

In a further aspect of the invention, a portion of the front plate is bent in to prevent the laterally-extending element from moving out of abutment with the lower bent-in tab.

In another embodiment of the invention, the lower support tab which provides an abutment for the laterally-extending pin extends from the lower edge of the outside plate of the bracket.

In a further aspect of the invention, a slanted edge is provided on the lower edge of the front plate opening to allow for easy movement of the pin between abutment with the lower edge of the front plate opening to abutment with the front edge of the lower tab.

BRIEF DESCRIPTION OF THE DRAWINGS

FIG. 1 is a perspective view of a seat having a reclining seat back and adjustable armrests;

FIG. 2 shows the reclining seat of FIG. 1 in a reclined position with the adjustable armrests adjusted to a position suitable for the inclination of the seat back;

FIG. 3 shows a prior art armrest bracket and pivotable armrest support member;

FIG. 4 shows a side perspective view of a preferred embodiment of an armrest bracket made in accordance with the present invention;

FIG. 5 shows another side perspective view of the armrest bracket of FIG. 4, showing the side of the bracket opposite the side shown in FIG. 4;

FIG. 6 shows the armrest bracket of FIG. 4 with seat cushion and armrest cushion portions partially broken away;

FIG. 7 shows the armrest bracket of FIG. 4 with the pivotable armrest support member in its middle position;

FIG. 8 shows the armrest bracket of FIG. 4 with the pivotable armrest support member in its stowed-away position;

FIG. 9 shows the armrest bracket of FIG. 4 with the pivotable armrest support member in its lowest position;

FIG. 10 shows a front plan view of the armrest bracket of FIG. 4, with the pivotable armrest support member in its lowest position;

FIG. 11 shows a partial cross-sectional view along line 11—11 of FIG. 10;

DETAILED DESCRIPTION OF THE PREFERRED EMBODIMENTS

Figure 12:
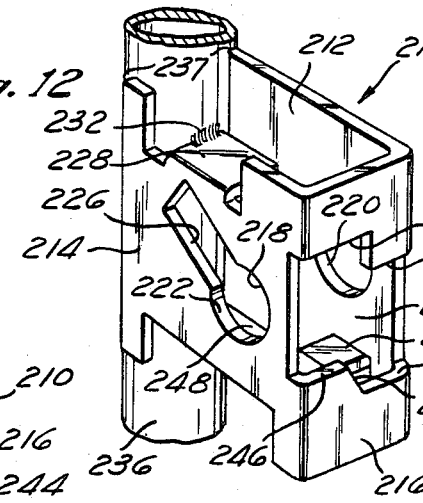
FIG. 12 shows a side perspective view of an another preferred embodiment of an armrest bracket made in accordance with the present invention.
Figure 13:
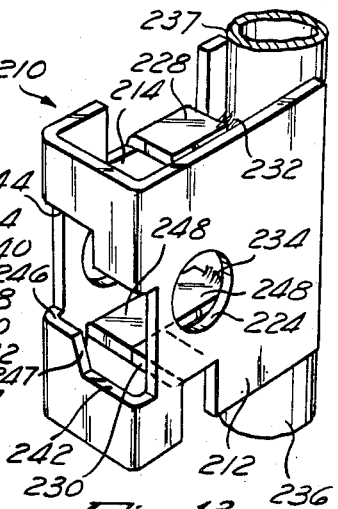
FIG. 13 shows another side perspective view of the armrest bracket of FIG. 12, showing the side of the bracket opposite that shown in FIG. 12.
Figure 14:
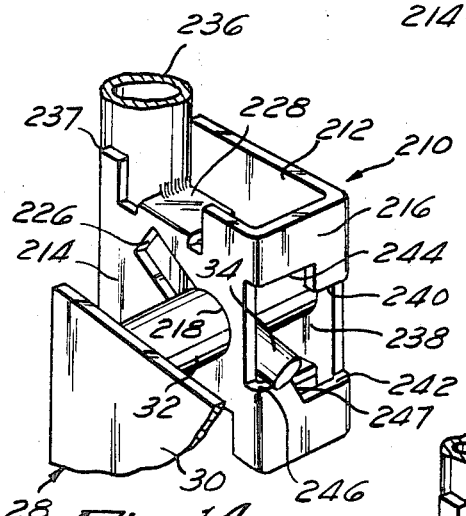
FIG. 14 shows the armrest bracket of FIG. 12 with the pivotable armrest support member in its middle position.
Figure 15:
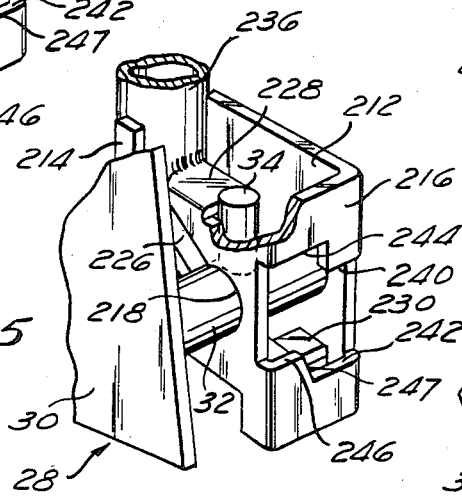
FIG. 15 shows the armrest bracket of FIG. 12 with the pivotable armrest support member in its stowed-away position.
Figure 16:
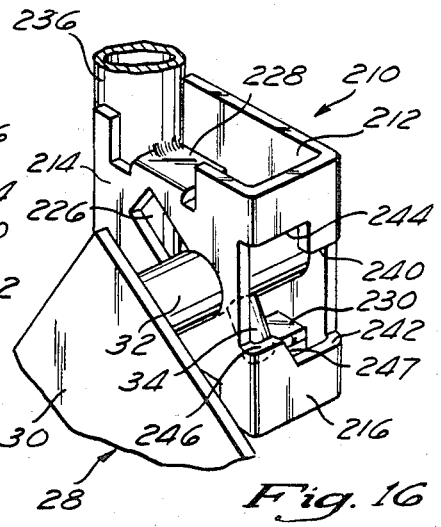
FIG. 16 shows the armrest bracket of FIG. 12 with the pivotable armrest support member in its lowest position.
Figure 18:
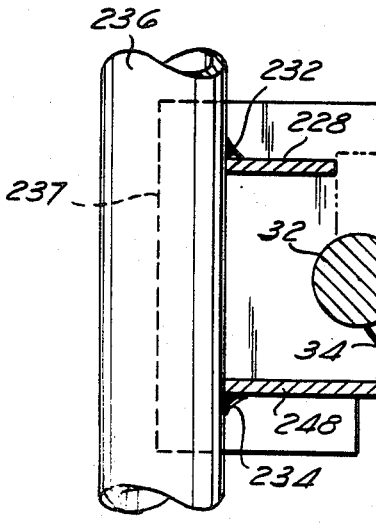
FIG. 18 shows a partial, cross-sectional side view along line 18—18.
Figure 17:
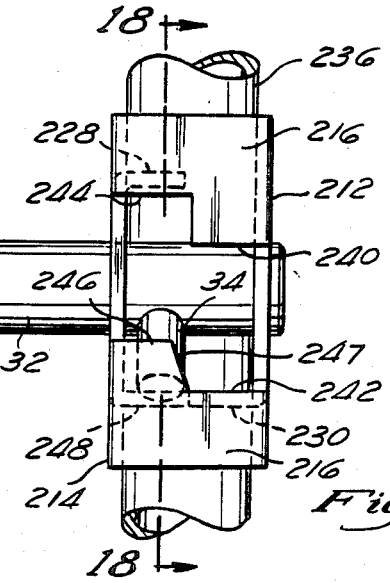
FIG. 17 shows a front plan view of the armrest bracket of FIG. 12 with the pivotable armrest support member in its lowest position.

The preferred embodiments will now be disclosed in detail having reference to the drawings and in particular to FIGS. 1–18.

The present invention is directed to an armrest bracket for use in connection with a reclining seat of the type wherein the seat back of the seat reclines while the seat bottom remains stationary. An example of this type of seat is shown in FIGS. 1 and 2. Seats of this type are most often found in vehicles, and especially recreational vehicles. However, reclining seats of this type are also found in many other environments.

The reclining seat 10 shown in FIG. 1 includes dotted lines 12 showing that the seat back 14 may be reclined rearwardly of the seat bottom 16 of the seat. Usually, a wide variety of reclining positions are provided for in a manner well known in the prior art. The brackets which connect the armrests 18, 20 to the frame of the seat back 14 are brackets made in accordance with the present invention. In FIG. 2, it can be seen that when a bracket made in accordance with the present invention is used to connect the armrests 18, 20 with the seat back frame, the armrest has three usable positions: (1) a stow-away position; (2) a medium or middle position; and (3) a lower position.

The stow-away position is shown by dotted lines 22 in FIG. 2. In the stow-away position the armrest is approximately parallel to the seat back frame. The medium position is shown in solid lines in FIG. 1 and by dotted lines 24 in FIG. 2. The medium or middle position has the armrest 18 extending from the seat back 14 at an angle of somewhat less than 90° so that when the seat back is in its upright position, the armrest is advantageously approximately parallel to the seat bottom. Finally, the third, lower position is shown in solid lines in FIG. 2 and is useful when the seat back 14 is reclined as shown in FIG. 2. In the lower position the armrests are at an acute angle with the seat back of about 45°. The lowest position can be used to maintain the armrests at an angle which is still approximately parallel with the seat bottom even when the seat back is reclined. Depending on the requirements of the customer, brackets made in accordance with this invention can be modified to provide somewhat different angles with respect to the seat back for each of the three positions.

FIG. 3 shows a prior art armrest bracket 26 and a pivotable armrest support member 28. It can be seen that the pivotable armrest support member 28 includes a solid rectangular steel plate 30. A cylindrical rod 32 extends from the back side of the plate 30 adjacent one end thereof. The cylindrical rod 32 is welded to the back side of the rectangular plate. At the other end of the cylindrical support rod 32 and spaced in from that end, a laterally-extending pin 34 is provided. This pin, like the support rod itself, is a solid cylindrical rod made of steel. The pin 34 is connected to the rod 32 by inserting the pin in an opening formed in the rod.

The prior art bracket 26 is U-shaped having an outside flat plate 36 and a parallelly oriented inside flat plate 38. A front plate 40 oriented perpendicular to the parallel flat plates 36, 38 connects the front ends of the outside and inside flat plate. At the open end 42 thereof, the U-shaped bracket 26 is welded to a portion of the side support 44 of the seat back frame. The bracket shown is designed for use on the left-hand side of the seat back frame. The bracket used on the right-hand side (not shown) is a mirror image of this bracket and thus there is no need for a separate description. As can be seen from FIG. 3, the portion of the seat back frame 44 to which the bracket is connected is a cylindrical, hollow metallic rod.

The outside plate 36 and the inside plate 38 have circular openings or holes 45, 46 which are aligned with one another. The edges 48, 50 of these openings provide a bearing surface for the cylindrical armrest support rod 32. The opening 48 in the outside plate has a downwardly and forwardly extending slot 52 which combines with the circular opening 48 to form a keyhole-like opening 48, 52 for acceptance of the laterally-extending pin 34 on the support rod 32.

In order to connect the pivotable armrest support member 28 to the armrest bracket 26, the cylindrical rod 32 is inserted into the opening 44 in the outside plate 36 and then through the opening 46 in the inside plate 38 of the bracket 26. The pivotable armrest support member 28 is then rotated until the laterally-extending pin 34 is aligned with the downwardly and forwardly extending slot 52. Then the rod 32 is inserted further into the bracket so that the laterally extending pin 34 is located between the two parallel plates 36, 38. The support rod 32 is pushed further towards the inside plate 38 until the laterally-extending pin 34 abuts against the inside plate 38. The pivotable armrest support 28 is then rotated counterclockwise, moving the laterally-extending pin 34 upwardly and through an opening 54 in the front plate 40 of the bracket. The lower edge of the opening in the front plate has a step-like configuration, with a lower level step 56 and an higher level step 58. The pivotable armrest support 28 is rotated further until the end of the pin 34 is at a level higher than the higher level step 58. The support 28 is then moved towards the outside plate so that the laterally-extending pin 34 abuts against the outside plate 36. The higher level step 58 is then directly below the pin 34 and when the pivotable armrest support is released and pressure is placed on the armrest, it will rotate so that the pin 34 comes into abutment with the higher level step 58 thus preventing any further clockwise movement of the pivotable armrest support member 28. This places the armrest in a position similar to the position in which the armrests of the seat shown in FIG. 1 are located.

The prior art bracket 26 also has a stow-away position. The stow-away position is reached by rotating the pivotable armrest support 28 from the position just described, counterclockwise until the pin 34 abuts against a bent-in tab 60 that extends inwardly from the top of the outside plate 36 of the bracket 26. This stowed-away position corresponds to the stow-away position shown by dotted lines 22 in FIG. 2. It is, however, not possible to put the armrest into a position like that shown by solid lines in FIG. 2 when using the bracket of FIG. 3. Thus, the prior art bracket shown in FIG. 3 provides only two usable positions, one useful when the seat back is in an upright position and the other being a stow-away position, for use when the seat back is reclined or when the user does not want an armrest.

A principal purpose of the present invention is to provide an armrest support bracket which can be directly substituted for the prior art bracket 26 shown in FIG. 3, and which provides for three usable positions instead of just two usable positions for the armrest. As indicated previously, the third position, which is provided by the present invention is the lower position shown in solid lines in FIG. 2. This position allows for the armrest to be located more nearly parallel to the seat bottom when the seat back is reclined.

A preferred embodiment of the invention will now be described in detail with reference to FIGS. 4-11. As shown in FIG. 4, the bracket 110 is advantageously U-shaped with an inside flat plate 112 and an outside flat plate 114. The bracket 110 shown is designed for use on the left-hand side of the seat back frame. The bracket used on the right-hand side (not shown) is a mirror image of the left-hand side bracket, and thus there is no need for a separate description. The flat plates 112, 114 are oriented parallel to one another and are connected at their front ends by a front plate 116 oriented perpendicularly to the two flat parallel plates 112, 114. The parallel plates 112, 114 have circular apertures 118, 120 therethrough aligned with one another to provide bearing surfaces 122, 124 for the cylindrical armrest support rod 32. A slot 126 for allowing entrance of the laterally-extending pin 34 of the cylindrical support rod 32 into the bracket 110 extends upwardly and rearwardly from the circular opening 118 in the outside plate. There is no similar slot extending from the side of the circular opening 120 in the inside plate 112. Two tabs 128, 130 are provided, one extending inwardly from the upper edge of the outside plate 114 and the other extending inwardly from the bottom edge of the inside plate 112 to properly position the bracket with respect to the seat back frame 136 and to provide welding points 132, 134 for connection of the bracket 110 to the frame 136. The bracket 110 is also secured to the seat back frame portion 136 by welding along the open edges 137 of the "U"-shaped bracket 110.

In order to connect the pivotable armrest support member 28 to the bracket, the cylindrical armrest support rod 32 is inserted into the circular opening 118 in the outside plate 114 and then through the circular opening 120 in the inside plate. The armrest support 28 is then rotated until the laterally-extending pin 34 is aligned with the upwardly extending slot 128 in the outside plate 114. The armrest support 32 is then pushed towards the inside plate until the laterally-extending pin 34 abuts against the inside plate 112. At this point, if the armrest support is rotated counterclockwise, the laterally extending pin will abut against the seat back frame 136. In order to move the armrest to a usable position, the armrest support 28 is rotated clockwise such that the laterally-extending pin 34 passes by the upper tab 128.

The front plate 116 has an aperture 138 therethrough forming an upper edge and a lower edge. The upper and lower edges each have a lower level step 140, 142 and a higher level step 144, 146. The lower level step 140 on the upper edge and the lower level step 142 on the lower edge are both adjacent the inside plate 112. The higher level step 144 on the upper edge and the higher level step 146 on the lower edge are both adjacent the outside plate 114. The rotation of the armrest support 28 is continued until the laterally-extending pin 34 abuts against the inside of the front plate 114 at a position just above the lower level step 140 on the upper edge of the front plate aperture. The armrest is then moved to the left such that the laterally extending pin 34 moves towards the outside plate into abutment with the inside surface of the outside plate 114. The armrest support 28 may then be rotated further in a clockwise direction such that the laterally-extending pin 34 passes under the higher level step 144 on the upper edge and through the opening 138 in the front plate 116. By continuing the rotation the pin 34 will abut against the higher level step 146 on the lower edge of the front plate opening 138. This is the medium or middle position corresponding to the position of the armrest shown in FIG. 1. The position of pin 34 is shown in FIGS. 6 and 7.

A stow-away position is also provided, and this can be reached by turning the armrest 38 counterclockwise from the middle position until the laterally-extending pin 34 abuts against the upper tab 128. This position is shown in FIG. 8. This position corresponds to the position shown in dotted lines 22 in FIG. 2 wherein the armrest is approximately parallel to the seat back.

Finally, as indicated previously, this bracket also allows for a third position which permits use of the armrest when the seat back is reclined to a position similar to that shown in FIG. 2. The armrest 18 of FIG. 2 is shown in this lower position. The lower position can be reached by turning the armrest support 28 clockwise from the stow-away position to the medium position and then pushing the armrest support 28 inwardly towards the inner plate until the laterally-extending pin 34 abuts against the inner plate 112. The armrest support member may then be turned an additional amount in the clockwise direction until the laterally-extending pin 34 abuts against the lower tab 130. The lower step 142 of the lower edge is low enough to permit the pin to pass through the front plate opening 138. This position may best be seen in FIGS. 9, 10 and 11.

Further, it can be seen that the lower tab 130 is advantageously significantly longer than the upper tab. This extra length acts to strengthen the support for the armrest when the pin 34 abuts against the edge of the lower tab 130. It should be noted that an inner tab 148 extending inwardly from the portion of the lower edge between the higher step 146 on the lower edge and the lower step 142 prevents movement of the armrest support towards the outside plate 114 when the armrest is in the lower position. Additionally, it should be recognized that lower tab 130 provides a number of functions including providing an abutment for the pin, assisting in locating the bracket in the proper position on the seat back frame and providing a weld point for connecting the bracket to the frame.

FIG. 6 shows how the armrest bracket 110, pivotable armrest support member 28 and the seat back frame 136 may be positioned in relation to the upholstery materials 150, 152 of the seat 10. This is important because these materials 150, 152 act to apply a spring-like force to the pivotable armrest support member 28, pushing the armrest support member 28 away from the left side of the seat back 14 by applying force to the end of the cylindrical rod 32 and to the inside surface of the armrest 18 itself. As will be explained, this is necessary for the proper functioning of the armrest support 28 in bracket 110.

As can be seen in FIG. 6, there is some constant pressure pushing against the armrest due to the foam used to upholster the seat. This is represented by an indentation 154 in the upholstery material of the seat shown in FIG. 6. In addition, the foam or other upholstery material 150, 152 also pushes against the end of the armrest support rod 32 as it extends beyond the inner plate 112 to the inner portion of the seat back 14. This force acts to push the armrest support 28 away from the seat to the left. Thus, it becomes clear that the bent-in tab 148 extending from the portion of the lower edge of the front plate opening 138 which connects the higher step 146 and lower step 142 is necessary in order to retain the laterally-extending pin 34 in position against the lower tab 130. Further, it can be seen that when the armrest is in the stow-away or in the middle position, the force acts to keep the pin to left in abutment with the upper tab 128 or the upper level step 146 of the lower edge, respectively. Although the force due to the upholstery is discussed only with respect to the FIGS. 4–11 bracket 110, the same discussion also applies to the FIGS. 12–18 bracket 210. Because of the force applied by the upholstery, it can be seen that movement between the lower level position and the middle position of the bracket 110 can be accomplished smoothly by simply rotating the armrest support 28 in a counter clockwise direction. There is no need to push or pull on the armrest to make this change in position. As soon as the pin reaches the level of the higher level step of the lower edge of the front plate opening the armrest support member will snap over to the left and abut against the higher level step.

Thus, a bracket 110 has been provided which can be directly substituted for the prior art bracket 26 shown in FIG. 3, and which provides for three usable armrest positions instead of just two. Additionally, the bracket 110, like the prior art bracket 26, is made of a single piece of material, preferably flat plate steel. This acts to minimize the expense of manufacturing. Finally, by orienting the keyhole slot upwardly instead of downwardly, as is done in the prior art bracket, it is believed that there is much less likelihood of accidental removal of the armrest member because the usual forces placed on the armrest member are clockwise, and not counterclockwise.

A second preferred embodiment will now be described with reference to FIGS. 12–18. The bracket 210 of FIGS. 12–18, like that of FIGS. 4–11, is U-shaped with two parallel flat plates 212, 214 connected at one end by a front plate 216. Like the bracket of FIGS. 4–11, this bracket is designed for use on the left-hand side of a seat back frame. The right-hand bracket (not shown) is a mirror image of this bracket and thus need not be described. Circular openings 218, 220 are provided in both of the parallel plates 212, 214 and are aligned to rotatably receive the cylindrical support rod 32 of the pivotable armrest support member 28. Like the bracket 110 of FIGS. 4–11, the opening in the outside plate 214 includes an upwardly and rearwardly extending slot 226 to allow passage through the plate of the laterally-extending pin 34 from the cylindrical armrest support rod 32. In order to properly position the bracket 210 with respect to the reclining seat back frame member 234, two bent-in tabs 228, 248 are provided. One tab 228 is bent in from the upper portion of the outside plate 214 and the other tab 248 is bent in from the lower portion of the outside plate 214. It can be seen that the portion of the seat back 236 to which the bracket is connected is a hollow tubular piece of metal. In addition to positioning the bracket 210 with the proper spacing from the tubular reclining seat back frame 236, these tabs 228, 248 also provide places 232, 234 for welding the bracket 210 to the seat back frame 236. The bracket is also welded to the seat back frame along the open edges 237 of the bracket 210 located adjacent the tubular seat back support element.

The front plate 216 has an opening 238 with an upper two-level stepped edge and a lower two-level stepped edge. The lower stepped edge of the opening in the front plate has two parallel surfaces or steps 242, 246 which are both perpendicular to the outside and inside flat plates. The step 246 closest to the outside plate is at a higher level than the step 242 closest to the inside plate.

The description of the movement of the cylindrical rod 32, and laterally extending pin 34 into the bracket 210 and into abutment with tab 228 for the stow-away position and the higher step 246 of the lower edge is identical to the corresponding description for the bracket 110 of FIGS. 4–11. Thus, the description will not be repeated here. In order to make the earlier description easy to follow, similar parts have been labeled with identical numbers except that the reference numerals for the FIGS. 12–18 bracket 210 are numbered in the 200's instead of the 100's.

The two parallel edge portions or steps 242, 246 are connected by a slanted angular edge portion 247. The slanted edge portion 247 is provided so that movement of the cylindrical armrest support rod 32 with its laterally-extending pin 34 from its middle position abutting against the higher step 246 of the lower edge of the front plate opening inwardly towards the inside plate 212 and then in a clockwise direction through the opening 238 in the front plate can be made more easily and smoothly.

A small tab 230 is bent in from the lower edge of the inside plate 212 so that when the cylindrical armrest support and laterally-extending pin 34 are moved from the medium position with the laterally-extending pin 34 in abutment with the upper step 246 of the lower edge of the front plate opening inwardly and in a clockwise direction, the laterally-extending pin 34 will abut against the small tab 230. The forces from the cushion and upholstery material surrounding the frame, armrest and armrest support bracket will then urge the armrest support bracket outwardly to the left so that the laterally-extending pin 34 will abut against the inside surface of the outside plate 214. When the armrest is released and force is placed downwardly on the armrest, the cylindrical rod 32 will rotate in a clockwise direction and the laterally-extending pin will abut against the front edge of the lower tab 248 which extends inwardly from the bottom portion of the outside plate 214.

It can be seen that the lower tab 248 extends all the way from the point of contact with the seat back frame 236 to the position where the laterally-extending pin 34 will abut against it. This can be best seen in FIG. 18. This long tab provides extra strength for supporting the armrest support 28 in the lower position. This is the position of the armrest 18 shown by solid lines in FIG. 2. Further, as with Tab 130 of bracket 110, tab 248 is built with a dual purpose in mind. One purpose is as an abutment for the laterally extending pin. The other purpose is to help properly position the bracket with respect to the seat back frame and to provide a welding point for attachment of the bracket to the frame.

It can be seen that the armrest support 28 and the armrest support bracket 110, 210 are built with strength and durability in mind. In particular, the armrest support element 28 is made of a plate of solid steel which is advantageously about 3/16 of an inch in thickness. A cylindrical, solid steel rod 32 is welded to the steel plate. This steel rod may advantageously have a diameter of about $\frac{3}{4}$ of an inch. Spaced inwardly from the end of the steel rod 32 is a laterally-extending steel pin 34 which has been inserted in a hole formed directly in the steel rod 32. The laterally-extending steel pin 34 advantageously has a diameter of about $\frac{3}{8}$ of an inch. Further, the laterally-extending steel pin extends about $\frac{5}{8}$ inch from the outside surface of the cylindrical steel rod. The brackets 110, 210 are advantageously each made from a single piece of plate steel having a diameter of about $\frac{1}{8}$ inch.

Thus, two preferred embodiments of the invention have been disclosed each of which provides a bracket having the strength and simplicity of the prior art bracket 26 shown in FIG. 3, while at the same time providing for three convenient positions for an armrest support. While this disclosure is directed specifically to use of the invention in connection with an armrest support, the principals of the present invention may well find applicability in other areas.

What is claimed is:

1. Apparatus comprising:

a seat back frame for a reclining seat;

a U-shaped bracket having an outside plate, an inside plate oriented parallel to the outside plate, and a front plate perpendicular to said parallel plates and secured to one end of each of the parallel plates;

said parallel plates having aligned circular openings, the opening in the outside plate having a notch extending at an angle upwardly and rearwardly from the circular opening to form a keyhole-like opening, a tab extending in from the upper portion of the outside flat plate, the bracket connected to the seat back frame member at the rear of the tab and at the open edges of the bracket;

an opening in the front plate having a lower stepped edge with a higher level step adjacent the outside plate and a lower level step adjacent the inside plate;

a tab extending inwardly from the bottom edge of the inside plate; and an armrest support member having a rectangular plate with a cylindrical rod extending from one side and adjacent one end of said plate, said cylindrical rod having a laterally-extending pin, said rod adapted to fit into the openings in the outside and inside plates and to allow rotating movement, the notch in the outside plate opening allows passage of the pin through the plate when the pin is aligned with the notch, said bracket providing three abutments for said pin which place said armrest support member at three angular positions with respect to the seat back frame, a stow-away position wherein the armrest support plate is generally parallel to the seat back frame, a middle position wherein the armrest support plate is at slightly less than 90° with respect to the seat back frame and a lower position wherein the armrest support plate is at an acute angle with the seat back frame.

2. The apparatus of claim 1, wherein the seat back frame and armrest support are upholstered and the upholstery cushioning provides a constant force pushing the armrest support member outwardly away from the seat back frame and armrest support bracket.

3. The apparatus of claim 1, wherein the lower tab extending from the bottom of the inside plate extends longitudinally from a location connected to the seat back frame to a location adjacent but spaced from the front plate of the bracket, a front plate tab extends parallel to and between the parallel plates from the lower edge of the front plate opening between the higher step and the lower step;

the higher step of the lower edge of the front plate opening is positioned in the path of the laterally extending pin whereby when the laterally extending pin is in abutment with the higher step the pivotable armrest support member is in its middle position;

the lower step of the lower edge of the front plate opening is positioned to permit passage of the pin through the front plate opening into the interior of the bracket when the armrest support member is moved towards the inside plate and then rotated so that the pin moves downwardly;

the front edge of the lower tab is positioned in the path of the laterally extending pin whereby when the pin is in abutment with the lower tab the pivotable armrest support member is in its lower position; and the front plate tab is positioned to prevent movement of the laterally-extending pin towards the inside surface of the outside plate when the pin is in the lower position.

4. The apparatus of claim 1, wherein the lower edge of the front plate opening between the higher step and the lower step is slanted with respect to the parallel plates to make the movement of the pin from abutment with the higher step to abutment with the lower tab easy.

5. The apparatus of claim 4, further comprising a second lower tab extending inwardly from the outside plate and extending longitudinally from the seat back frame to a point adjacent but spaced from the front plate, the front edge of said second lower tab positioned to provide an abutment for the laterally extending pin at the lower position of the pivotable armrest support member.

6. The apparatus of claim 5, wherein the front edge of the second lower tab is aligned with the front edge of the lower tab extending from the inside plate.

7. The apparatus of claim 1, wherein the U-shaped bracket is of single piece construction.

8. A bracket comprising:

two aligned, spaced apart circular bearing surfaces positioned and sized to accept a pivotable cylindrical rod, the center points of the two circular bearing surfaces defining an axis;

one of said bearing surfaces having an opening therein to permit passage of a pin extending laterally from the pivotable cylindrical rod;

a flat plate spaced from said bearing surfaces and arranged parallel to said bearing axis, said flat plate having an opening with an edge including a first step and a second step;

an abutment positioned at approximately the same distance from the bearing axis as said first step, the angle formed between the line passing through the bearing axis and the abutment and the line passing through the bearing axis and the edge of the flat plate opening of the first step is approximately 45°; wherein the abutment is aligned with the second step; and a maintaining member is provided extending from the flat plate between the first and second steps of the edge of the flat plate opening, generally perpendicular to the flat plate and extending generally in the direction of the first abutment.

9. The bracket of claim 8, wherein the abutment is aligned with the first step.

10. The bracket of claim 8, wherein the bracket is formed of single piece construction.

11. A bracket comprising:

an outside plate, an inside plate oriented parallel to the outside plate, and a front plate oriented perpendicular to said parallel plates and secured to one end of each of the parallel plates;

said parallel plates having aligned circular openings, the opening in the outside plate having a notch extending at an angle upwardly and rearwardly from the circular opening to form a keyhole like opening;

an upper tab extending in from the upper portion of the outside flat plate;

an opening in the front plate having a lower edge with a higher level step adjacent said outside plate and a lower level step adjacent said inside plate;

a lower tab located between the parallel plates and below the level of the lower step of the lower edge of the front plate opening;

whereby when a cylindrical armrest support rod having a laterally extending pin is inserted into the bracket three angular positions are provided for the armrest, a stow-away position with the pin abutting against the upper tab, a middle position with the pin abutting against the higher level step of the lower edge of the front plate opening and a lower position with the pin abutting against the lower tab.

12. The apparatus of claim 11, wherein said lower tab extends from the bottom edge of the inside plate inwardly towards the outside plate, the front edge of the lower tab adjacent to but spaced from the front plate.

a front plate tab extends from the lower edge of the front plate opening between the higher step and the lower step between the parallel plates whereby when the pin of the cylindrical rod abuts against the lower tab the front plate tab prevents movement of the pin in a lateral direction towards the outside plate.

13. The bracket of claim 11, wherein the lower edge of the front plate opening between the higher step and the lower step is slanted with respect to the parallel plates to make the movement of the pin from abutment with the higher step to abutment with the lower tab as easy as possible.

14. The apparatus of claim 12, wherein the lower tab extends inwardly from the bottom edge of the outside plate and is positioned to provide an abutment for the laterally extending pin at the lower position.

15. The apparatus of claim 14, further comprising a second lower tab extending from the bottom edge of the inside plate, the front edge of said second lower tab aligned with the front edge of the first mentioned lower tab extending from the outside plate.

16. The bracket of claim 11, wherein the lower tab extends from a position adjacent but spaced from the front plate to a position adjacent the rear end of the bracket whereby a strong support is provided for abutment with the armrest pin and the bracket is easily positioned in its proper place for connection to a tubular frame.

17. The bracket of claim 12, wherein the lower tab extends from a position adjacent but spaced from the front plate to a position adjacent the rear end of the bracket whereby a strong support is provided for abutment with the armrest pin and the bracket is easily positioned in its proper place for connection to a tubular frame.

18. The bracket of claim 15, wherein the lower tab extends from a position adjacent but spaced from the front plate to a position adjacent the rear end of the bracket whereby a strong support is provided for abutment with the armrest pin and the bracket is easily positioned in its proper place for connection to a tubular frame.

19. The bracket of claim 11, wherein the bracket is of single piece construction.

* * * * *